US006659084B2

(12) United States Patent
Melsheimer et al.

(10) Patent No.: US 6,659,084 B2
(45) Date of Patent: Dec. 9, 2003

(54) EXTENDED PUMP-VALVE-NOZZLE UNIT HAVING HYDRAULIC-MECHANICAL TRANSLATION

(75) Inventors: Anja Melsheimer, Stuttgart-Vaihingen (DE); Matthias Beck, Stuttgart (DE); Manfred Mack, Altheim (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/030,707

(22) PCT Filed: May 3, 2001

(86) PCT No.: PCT/DE01/01682

§ 371 (c)(1),
(2), (4) Date: Apr. 26, 2002

(87) PCT Pub. No.: WO01/86137

PCT Pub. Date: Nov. 15, 2001

(65) Prior Publication Data

US 2002/0190135 A1 Dec. 19, 2002

(30) Foreign Application Priority Data

May 12, 2000 (DE) ..... 100 23 236

(51) Int. Cl.[7] ..... F02M 37/04
(52) U.S. Cl. ..... 123/446; 123/447
(58) Field of Search ..... 123/446, 447, 123/506; 239/88–93

(56) References Cited

U.S. PATENT DOCUMENTS 3,566,849 A * 3/1971 Frick ..... 239/88
4,782,807 A * 11/1988 Takahashi ..... 123/506
5,954,033 A * 9/1999 Moncelle ..... 123/467
6,247,450 B1 * 6/2001 Jiang ..... 123/446

* cited by examiner

*Primary Examiner*—Thomas N. Moulis
(74) *Attorney, Agent, or Firm*—Ronald E. Greigg

(57) ABSTRACT

The invention relates to a fuel injection apparatus for an internal combustion engine, having an injection valve that protrudes into the combustion chamber of the engine. This valve communicates with a valve chamber in that a control part closes and opens inlet bores for fuel that is at high pressure. The control part is actuatable by means of a hydraulic-mechanical booster. The pump part, valve part and nozzle part of the fuel injection apparatus are disposed in a vertical arrangement, hydraulically in line with on another in terms of the fuel flow.

9 Claims, 2 Drawing Sheets

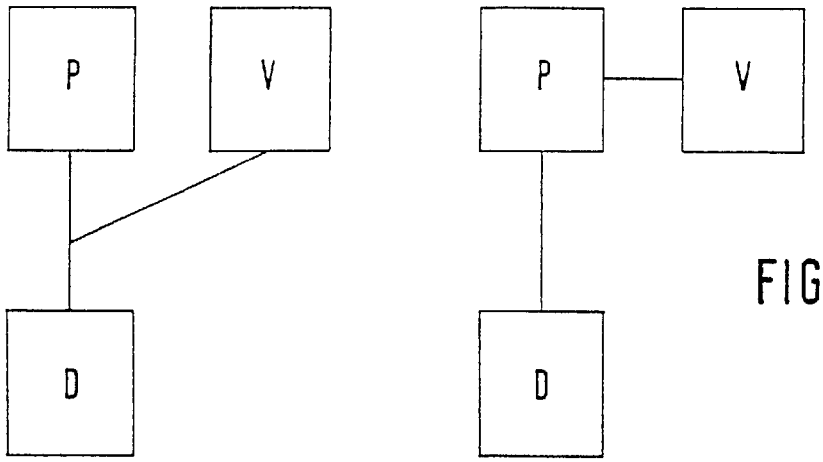
FIG. 1
FIG. 2
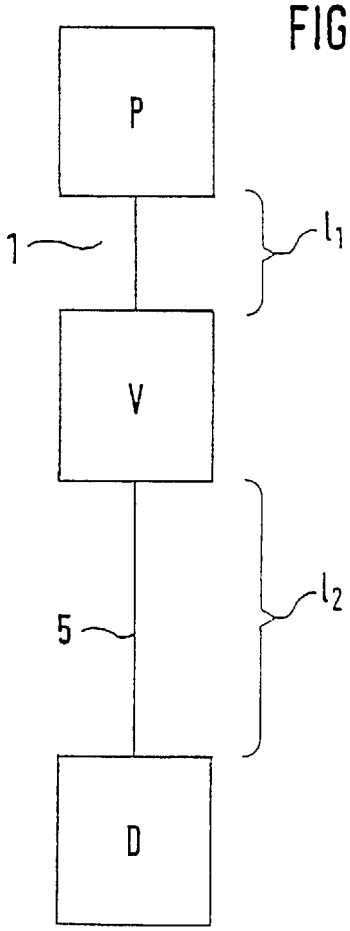
FIG. 3
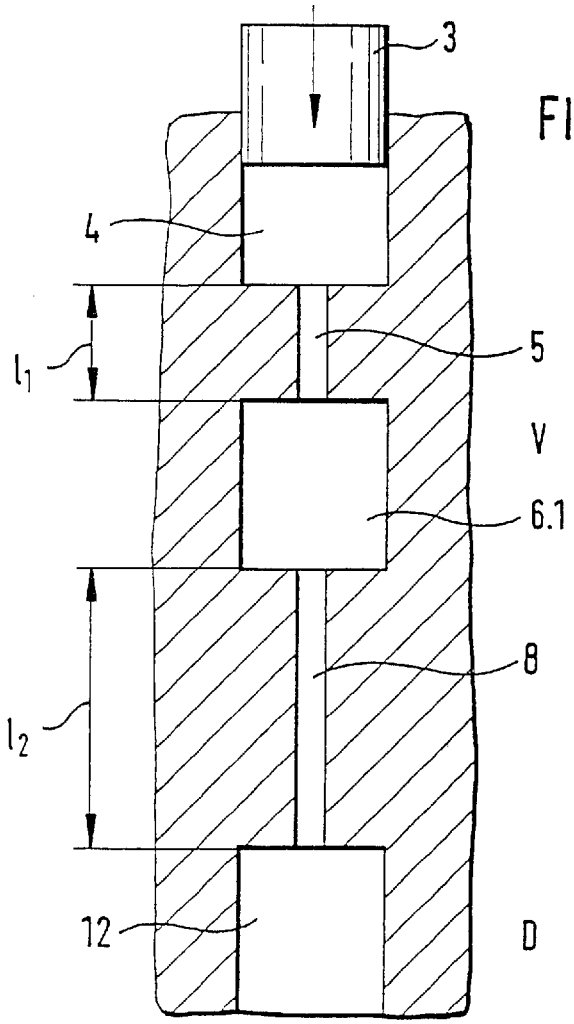

EXTENDED PUMP-VALVE-NOZZLE UNIT HAVING HYDRAULIC-MECHANICAL TRANSLATION

CROSS-REFERENCE TO RELATED APPLICATIONS

This application is a 35 U.S.C. 371 application of PCT/DE 01/01682, filed on May 3, 2001.

BACKGROUND OF THE INVENTION

1. Field of the Invention

The present invention relates to a pump-valve-nozzle unit (PVD) in an elongated arrangement with hydraulic-mechanical boosting.

The structure of modern internal combustion engines, where up to four valves can be provided per cylinder, severely limits the available installation space in the cylinder head for injection systems. Moreover, hydraulic-mechanical boosters are assigned to the pump-valve-nozzle units and must also be accommodated.

2. Description of the Prior Art

German Patent Disclosure DE 39 10 793 A1 relates to a fuel injection apparatus for Diesel engines with at least one pump piston. This pump piston is guided sealingly in a bush and together with the pump body forms a pumping chamber, which during the downward motion of the pump piston communicates by means of a control element with a suction chamber, and via an injection line, the pumping chamber communicates with an injection valve. The object of the invention is to keep the idle volume of the fuel injection apparatus as small as possible, to make high injection pressures feasible. This is attained by providing a permanently open communication in terms of flow between the pumping chamber and the injection valve.

German Patent Disclosure DE 198 99 627 A1 relates to a fuel injection apparatus for internal combustion engines. It includes a high-pressure fuel pump, which communicates on the intake side with a low-pressure fuel supply system and on the high-pressure side with a fuel injection valve that protrudes into the engine combustion chamber. The high-pressure pumping into a high-pressure conduit provided between the high-pressure fuel pump and the fuel injection valve is controllable by means of an electrical control valve, which has an electrically actuatable, displaceable valve member with a valve sealing face. By its valve sealing face, it cooperates with a stationary valve seat to form a sealing cross section. To improve the control times and vulnerability of the control valve to wear, the control valve member and/or a sleeve that guides it are made of ceramic.

In the arrangements of fuel injection apparatuses discussed above from the prior art, pressure pulsations can occur in the system because of the L-shaped arrangement of the valve relative to the injection nozzle.

SUMMARY OF THE INVENTION

With the arrangement proposed according to the present invention, an arrangement extending essentially in the vertical direction of a pump part, a valve part adjoining it, and a nozzle part adjoining the valve part, in an injection arrangement can be assured. With this essentially vertically extending arrangement of the pump, valve, and nozzle components, a largely flow-free pressure buildup can be achieved. According to this arrangement, the pump, valve and nozzle components are all located one after the other in hydraulic terms. The elongated arrangement of pump-valve-nozzle units allows a hydraulic-mechanical booster to be flanged laterally to them. Because of the essentially vertically extending arrangement of the pump part, valve part and nozzle part, a length ratio between these parts, that is, between the pump chamber and the control valve chamber and between the control valve chamber and the nozzle chamber, of 1:5 can optimally be achieved. As a result, excessively long injection lines can be avoided; instead, the time constant of an injection is now substantially greater, compared to the time for wave propagation between the individual elements, such as to the nozzle chamber. As a consequence, the pronounced pressure fluctuations that occur in the arrangements of PDE units in the versions of the prior art between the pump components, that is, the pump part, valve part and nozzle part, can be suppressed in the embodiment according to the invention. The adverse effects of such resultant pressure pulsations in lines that are designed as overly long and are at high pressure can cause undesired phenomena such as undesired opening, fluttering or closure of a nozzle needle that opens above that pressure, which in an extreme case can cause unstable needle opening behavior as well as nozzle needles that close again, depending on the rotary speed of the cam that drives the pump body.

With a pump-valve-nozzle unit disposed in accordance with the present invention, these disadvantages can be avoided by means of an inlet bore system which is designed with optimal length ratios. As a result of the elongated arrangement of the pump part, valve part and nozzle part, it is furthermore optimally possible to economize on installation space, so that enough structural space per cylinder of an internal combustion engine is available to provide two high-pressure injection valves, even if these valves are provided with laterally flanged-on piezoelectric actuators for actuating the control valve, together with a hydraulic-mechanical booster received thereon.

Since an additional mechanical boosting is provided on the piezoelectric actuator, the valve chamber can be optimally designed with regard to the length ratios of the line systems. Mounting the hydraulic-mechanical booster by flanging it on laterally results in a simple adjustment of the requisite mechanical stroke courses required to actuate the control valve. Since the actuating unit includes a mechanical booster, in the form of a lever that is pivotable about a pivot axis, the hydraulic boosting volume can be kept small and can be operated at very low pressures (only 6 bar).

Furthermore, the vertical arrangement of PDE units of an injector proposed according to the invention has the advantage that instead of the previously required three to four high-pressure bore intersections in the injector body, now only two high-pressure bore intersections are required in the injector body. To assure a resistance to pressure pulsations of up to about 2000 bar for an injector body for high-pressure Diesel injection systems, the high-pressure bore intersections must be minimized, since they impair the mechanical loadability of the injector body. The high-pressure bore intersections define the limit for the mechanical loading of an injector body, which accordingly sets a limitation to the attainable pressure level in the high-pressure collection chamber (common rail).

BRIEF DESCRIPTION OF THE DRAWINGS

The invention is described in further detail below in conjunction with the drawings, in which:

FIG. 1 schematically illustrates two pump-valve-nozzle part systems of an injection system, which are known from prior-art embodiments and extend in the shape of a Y or L;

FIG. 2 schematically illustrates the arrangement proposed according to the invention for the components of a pump-valve-nozzle system of an injector;

FIG. 3 illustrates the optimal line length ratios, with regard to the buildup of pressure fluctuations, for the fuel lines of an injection system that connect the pump chamber, valve unit and nozzle part to one another.

DESCRIPTION OF THE PREFERRED EMBODIMENTS

Figure 4:
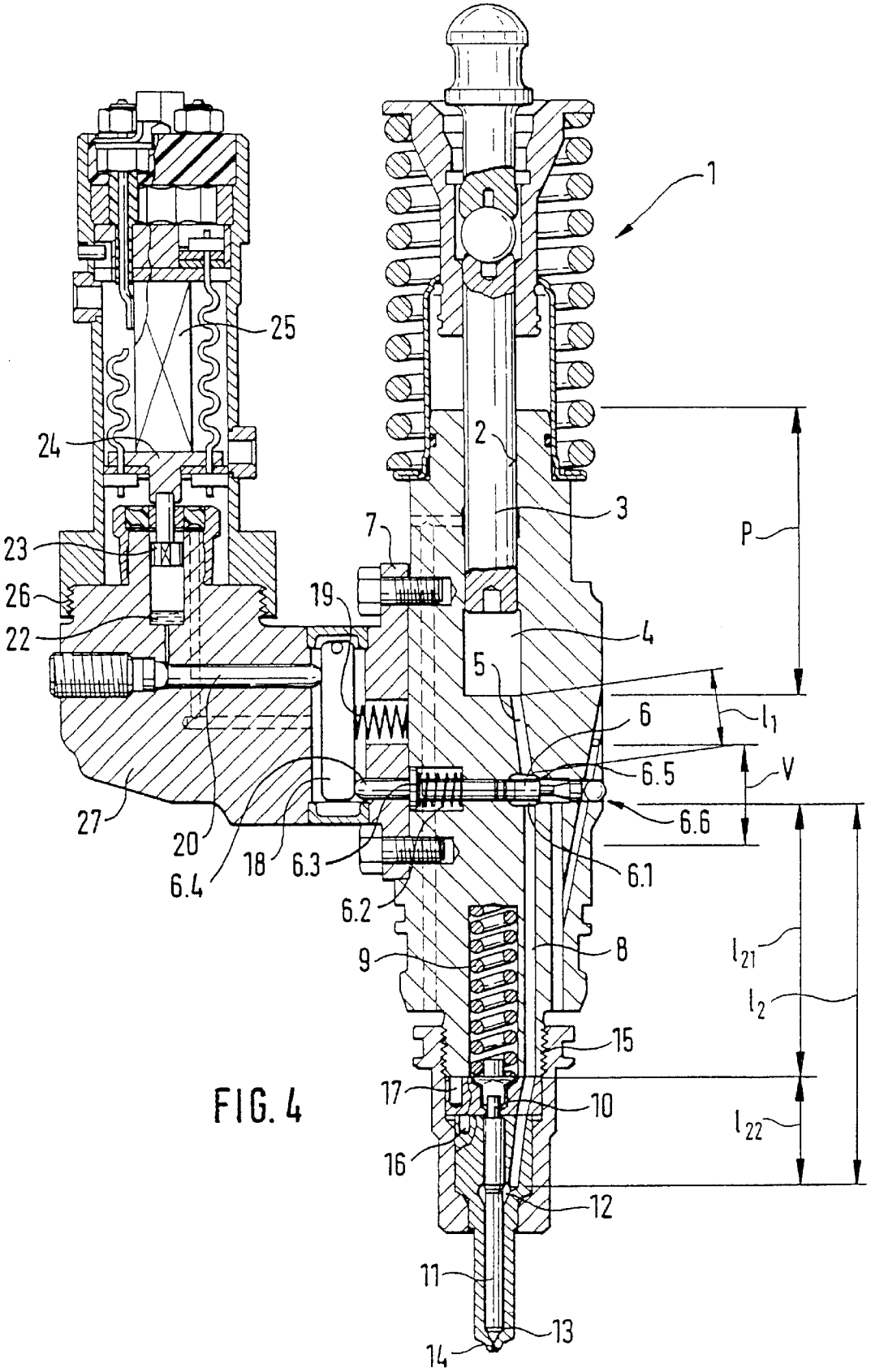
FIG. 4 is a sectional view of a variant embodiment of the pump-valve-nozzle unit, proposed according to the invention, with a hydraulic-mechanical booster flanged laterally in the region of the valve part.

In FIG. 1, the arrangements of components, extending in the shape of Y or L, that result in previous versions of pump-valve-nozzle systems are shown.

From the standpoint of the hydraulic design in terms of the vulnerability of a pump-valve-nozzle system to the buildup of pressure fluctuations, a vertical arrangement of the pump part, valve part and nozzle part of an injection system is a desirable goal. The valve chamber must not be connected parallel to the pump chamber; moreover, the injector arrangements shown schematically in FIG. 1 require not inconsiderable installation space in the region of the cylinder head of an internal combustion engine, and with the increasing progress of four-valve technology this space is becoming smaller and smaller.

FIG. 2 schematically shows the arrangement, proposed according to the invention, of the components of a pump-valve-nozzle system of an injector.

The essential components of the fuel injection apparatus 1 are disposed in the vertical direction. In terms of the fluid direction of the fuel, coming at high pressure from the pump part P, the components P, V an D are disposed hydraulically one after the other. With this configuration, installation space, which is only extremely scarce at the cylinder head of an internal combustion engine, is saved on the one hand; on the other, the supply line connecting the individual parts P, V and D of the fuel injection apparatus can be designed with an optimal length. Thus an optimal behavior with regard to developing pressure fluctuations in the fuel that is at high pressure in the supply lines can be attained whenever the length ratio of the supply lines 5 and 8, that is, the ratio $l_1$:$l_2$, is in the range between 1:4 and 1:6. Preferably, the length ratio of the two inlet bores 5 and 8 is 1:5 (see the view shown in FIG. 3). By means of this selected length ratio of the inlet or connecting lines between the components of the pump-valve-nozzle system of a fuel injection apparatus 1, a maximally fluctuation-free pressure buildup in the fuel injection apparatus 1 is attainable. A pressure buildup without fluctuations within a pump-valve-nozzle system offers the possibility, as injection systems undergo further refinement, of achieving a boot preinjection, which in an injection system, which involves major pressure pulsations, can be achieved only at great difficulty; in particular, the precision of the preinjection or boot quantities to be metered leaves much to be desired.

The view shown in FIG. 3 illustrates the optimal spacing ratios, in terms of the buildup of pressure fluctuation, of the pump part, valve part and nozzle part of a fuel injection apparatus.

In the view in FIG. 3, the pump part, comprising the pump piston 3, which plunges into the pump chamber 4, communicates with the valve chamber 6.1 via the inlet bore 5. The length of the inlet bore 5 that connects the pump chamber 4 to the valve chamber 6.1 is designated as $l_1$. From the valve chamber 6.1, the inlet bore 8 extends through the injector body to the nozzle chamber, designated by reference numeral 12. The axial length of the segment of the inlet bore 8 between the valve chamber 6.1 and the nozzle chamber 12 of the injector body is marked $l_2$. As indicated above in conjunction with the view shown in FIG. 2, the ratio of the lengths $l_1$, $l_2$ of the inlet bore 5 to the inlet bore 8 is advantageously in the range between 1:4 and 1:6, and preferably the length ratio $l_1$: $l_2$ is 1:5. With these length ratios of the inlet bores 5 and 8 in the interior of the injector body of the fuel injection apparatus 1, the buildup of pressure fluctuations in fuel that is at high pressure can be effectively avoided.

The view shown in FIG. 4 illustrates a variant embodiment of the pump-valve-nozzle unit proposed according to the invention, with a hydraulic-mechanical booster flanged laterally in the region of the valve part V.

The injector 1 includes a pump part P in its upper region. The pump part receives a pump piston 3 provided coaxially to the line of symmetry of the injector body 1 in a bore 2, and this pump piston is acted upon by a cap together with a compression spring surrounded by the cap. The pump piston 3 plunges into a pump chamber 4 and in this way puts a fuel supply present there under pressure. From the pump chamber 4, a bore 5 extends into a valve chamber 6.1 of a control valve 6, which is received in a valve part V of the injector of the fuel injection apparatus 1.

The length of the inlet bore 5 between the pump chamber 4 and the valve chamber 6.1 is designated $l_1$. The control part 6, which in the region of the inlet bore 5 is surrounded by the pump chamber 4 and in the region of the inlet bore 8 toward the nozzle chamber 12 is surrounded by a valve chamber 6.1, is surrounded by a restoring spring 6.2, which with one end contacts a stop face 6.3 and with its other end rests on a bore wall in the interior of the injector body. With the seat face 6.5, the control part 6 closes off the communication between the inlet bores 5 and 8. Also embodied on the control part 6 is a tappet rod 6.4, whose rounded head protrudes laterally out of the injector body 1. In the position of the control part 6 shown in FIG. 4, the tappet rod is in the closing position 6.6, by contact of the seat face 6.5 with the edge of the valve chamber 6.1.

From the valve chamber 6.1 of the valve part V, an inlet bore 8, which extends substantially parallel to the axis of symmetry of the valve body 1, extends to the nozzle chamber 12. The nozzle chamber 12 is penetrated by a nozzle needle 11, whose nozzle seat 13 is embodied on the tip of the injector body 1 and either closes or opens a nozzle opening 14, which protrudes into the combustion chamber of an internal combustion engine. Above the nozzle needle 11, a thrust member 10 is shown, which by means of a plate can be acted upon by a compression spring 9 located above it and entirely surrounded by the injector body housing. The nozzle part D of the fuel injection apparatus is located at a spacing $l_2$ from the valve part of the pump-valve-nozzle unit of the fuel injection apparatus 1. The ratio of the length $l_1$ of the inlet bore 5 to the length of the inlet bore 8 between the valve chamber 6.1 of the valve part V and the nozzle chamber 12 of the nozzle part D is advantageously essentially 1:5, in accordance with the description given above.

For easier communication of the nozzle part D with the other components of the fuel injection apparatus 1, the nozzle part D is connected to the injector body 1 by means of a screw fastening 15. The centering of the nozzle part D to assure the alignment of the inlet bore 8 in the nozzle chamber 12 is made possible by the centering pins 16 and 17, which are provided between the components to be mounted to one another.

A booster flange 7, in which a booster lever 18 that is pivotable about an axis is received, is disposed on the side face of the injector. The booster lever 18 is in turn acted upon by a restoring spring 19 and with its other end is in communication with the rounded end of the tappet rod 6.4 of the control part 6. Via the secondary piston 20 provided in the flange 7, 27, the rotatably supported booster lever 18 is moved about its pivot point. The secondary piston 20 communicates, via a communication extending in the form of a gap, by means of a booster flange 27 with a leak fuel supply 22, which can be acted upon by a primary piston 23 and causes an actuation of the secondary piston 20. Above the primary piston 23 is a bearing plate 24, which in turn can be actuated via a piezoelectric actuator 25. The piezoelectric actuator 25 is screwed to the booster flange 27 at an actuator screw fastening 26. By means of the lever ratios at the booster lever 18 relative to the force introduction point by means of the secondary piston 20 and with respect to the tappet rod 6.4 for actuating the control part 6, which represent an additional mechanical boost, the hydraulic boosting volume can be kept small and can be operated at low pressures, such as 6 bar, for replenishment via the leak fuel pressure. The mechanical wear that occurs between the valve actuation components 20, 18 and 6.4 can be compensated for very easily by means of a replenishing volume via the leakage gap between the primary piston 23 and the secondary piston 20.

With this embodiment, high-pressure bore intersections in the injector body can be avoided and reduced to the number of two, so that a weakening of the injector body of the fuel injection apparatus 1 can be reduced to a minimum. The injector body of the fuel injection apparatus of FIG. 4 has a pressure pulsation resistance to pressures of up to at least 2000 bar and advantageously, by integration of the compression spring 9 that acts on the nozzle needle 11, avoids a further flat high-pressure sealing face. At the requisite pressures in injection systems of 2000 bar and higher, sealing faces are potential weak points, and must therefore be avoided wherever possible.

The foregoing relates to preferred exemplary embodiments of the invention, it being understood that other variants and embodiments thereof are possible within the spirit and scope of the invention, the latter being defined by the appended claims.

We claim:

1. A fuel injection apparatus for an internal combustion engine having: a pump part (P): a nozzle part (D) with an injection nozzle (14) protruding into the combustion chamber of the engine, which nozzle is in communication with a valve chamber (6.1); and a valve part (V) in which a control part (6) closes and opens inlet bores (5, 8) for fuel that is at high pressure, and the control part (6) is actuatable by means of a hydraulic-mechanical booster (18, 19, 20, 21), the improvement wherein the pump part (P), the valve part (V) and the nozzle part (D) of the fuel injection apparatus (1) are disposed in a vertical arrangement, hydraulically in line with one another in terms of the fuel flow, wherein the ratio of the lengths $l_1$:$l_2$ of the inlet bores (5, 8) relative to one another is between 1:4 and 1:6.

2. The fuel injection apparatus of claim 1, wherein the pump chamber (4), valve chamber (6.1) and nozzle chamber (12) communicate with one another via substantially vertically extending inlet bores (5, 8).

3. The fuel injection apparatus of claim 2, wherein the length ratio $l_1$:$l_2$ of the inlet bores (5, 8) is about 1:5.

4. The fuel injection apparatus of claim 1, wherein the control part (6) of the valve part (V) is actuatable by means of a hydraulic-mechanical booster (18, 19, 20, 21), which is flanged laterally to the fuel injection apparatus (1) in the region of the valve part (V).

5. A fuel injection apparatus for an internal combustion engine having: a pump part (P): a nozzle part (D) with an injection nozzle (14) protruding into the combustion chamber of the engine, which nozzle is in communication with a valve chamber (6.1); and a valve part (V) in which a control part (6) closes and opens inlet bores (5, 8) for fuel that is at high pressure, and the control part (6) is actuatable by means of a hydraulic-mechanical booster (18, 19, 20, 21), the improvement wherein the pump part (P), the valve part (V) and the nozzle part (D) of the fuel injection apparatus (1) are disposed in a vertical arrangement, hydraulically in line with one another in terms of the fuel flow, wherein a tappet rod (6.4) of the control part (6) is actuatable via a pivotably supported booster lever (18) counter to the action of a restoring spring (19), and the pivot lever (18) is moved by a secondary piston (20).

6. A fuel injection apparatus for an internal combustion engine having: a pump part (P): a nozzle part (D) with an injection nozzle (14) protruding into the combustion chamber of the engine, which nozzle is in communication with a valve chamber (6.1); and a valve part (V) in which a control part (6) closes and opens inlet bores (5, 8) for fuel that is at high pressure, and the control part (6) is actuatable by means of a hydraulic-mechanical booster (18, 19, 20, 21), the improvement wherein the pump part (P), the valve part (V) and the nozzle part (D) of the fuel injection apparatus (1) are disposed in a vertical arrangement, hydraulically in line with one another in terms of the fuel flow, wherein a piezoelectric actuator (25) acting on a primary piston (23) is received on the hydraulic-mechanical booster (18, 19, 20 and 21), and the primary piston (23) hydraulically acts on a secondary piston (20) via a leakage gap.

7. A fuel injection apparatus for an internal combustion engine having: a pump part (P); a nozzle part (D) with an injection nozzle (14) protruding into the combustion chamber of the engine, which nozzle is in communication with a valve chamber (6.1); and a valve part (V) in which a control part (6) closes and opens inlet bores (5, 8) for fuel that is at high pressure, and the control part (6) is actuatable by means of a hydraulic-mechanical booster (18, 19, 20, 21), the improvement wherein the pump part (P), the valve part (V) and the nozzle part (D) of the fuel injection apparatus (1) are disposed in a vertical arrangement, hydraulically in line with one another in terms of the fuel flow, wherein wear of the mechanical components (6.4, 18, 20) is compensated for by a replenishing flow of leak fuel (22) between booster pistons (20, 23).

8. The fuel injection apparatus of claim 6 wherein wear of the mechanical components (6.4, 18, 20) is compensated for by a replenishing flow of leak fuel (22) between the primary and secondary pistons (20, 23).

9. The fuel injection apparatus of claim 1, wherein a compression spring (9) acting on the nozzle needle (11) in the nozzle part (D) is integrated with the injector housing of the fuel injection apparatus (1).

* * * * *